United States Patent [19]

Palmer

[11] Patent Number: 4,459,782

[45] Date of Patent: Jul. 17, 1984

[54] BELT GRINDING WITH CONTROLLED COOLANT FLOW

[76] Inventor: Donald C. Palmer, 15902 SE. Heidi La., Clackamas, Oreg. 97015

[21] Appl. No.: 418,988

[22] Filed: Sep. 16, 1982

[51] Int. Cl.[3] ..... B24B 21/00

[52] U.S. Cl. ..... 51/141; 51/135 R; 51/267

[58] Field of Search ..... 51/135 R, 141, 356, 51/267, 322, 266; 165/120; 62/60; 134/115, 134/172, 182, 183, 198; 126/432–437, 442–447; 198/811, 500

[56] References Cited

U.S. PATENT DOCUMENTS

| | | | |
|---|---|---|---|
| 1,036,783 | 8/1912 | Bein | 51/135 R |
| 2,367,107 | 1/1945 | Emmons | 51/267 |
| 3,395,495 | 8/1965 | Powanda | 51/267 |

*Primary Examiner*—Frederick R. Schmidt
*Assistant Examiner*—Matthew D. Daschel
*Attorney, Agent, or Firm*—Kolisch, Hartwell, Dickinson & Anderson

[57] ABSTRACT

A belt grinder cooling method and apparatus featuring specially controlled flows of a coolant liquid—one in the interface region between the working run of the belt and a supporting platen, another in the interface region between a workpiece and the belt's working run, and a third onto the belt downstream from where the belt contacts a workpiece.

9 Claims, 4 Drawing Figures

BELT GRINDING WITH CONTROLLED COOLANT FLOW

BACKGROUND AND SUMMARY OF THE INVENTION

This invention relates to a grinder of the type having an endless belt supported by a platen, and more particularly to a method and apparatus for cooling such a device and an associated workpiece during a grinding operation.

Conventional platen-supported belt grinding machines generally include an elongated, endless abrading belt having a working run supported by a generally planar, horizontal platen, with the belt trained over a pair of laterally spaced rollers. During a typical grinding operation, an operator manually presses a workpiece against the belt's working run. When a grinder operates on a metal workpiece, such as an engine block, a substantial amount of heat is generated. Such heat makes it very difficult for the operator to hold the workpiece. In addition, excessive heat may cause warpage of, and other damage to, the workpiece.

Accordingly, it is a general object of the present invention to provide, with reference to a grinder of the type generally outlined, a unique method and apparatus for dissipating the heat generated during a grinding operation.

A more specific object is to provide, with respect to a platen-supported belt grinder, a novel method and apparatus for introducing a controlled flow of coolant liquid into the interface region between the platen and the working run of the belt.

A further object of the invention is to introduce a flow of coolant liquid into the interface region between the working run of the belt and a workpiece.

Yet another object is to provide means for distributing coolant liquid onto the belt at a location which is downstream from where the belt contacts a workpiece.

These and other objects and advantages which are attained by the invention will become more clearly understood from a consideration of the drawings and the detailed description of a preferred embodiment of, and method of practicing, the invention.

DETAILED DESCRIPTION OF THE INVENTION

Figure 2:
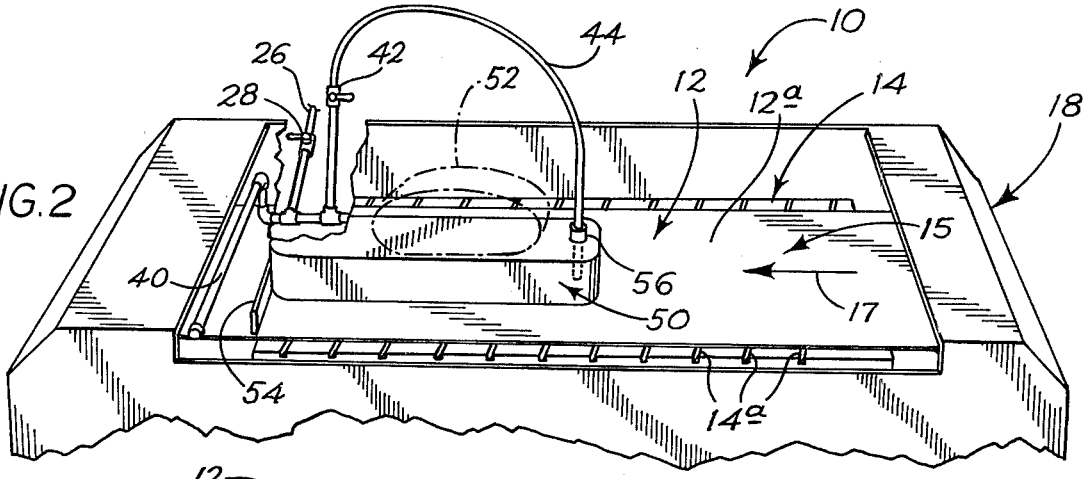
FIG. 2 is a fragmentary top perspective view of details of the grinder of FIG. 1.
Figure 1:
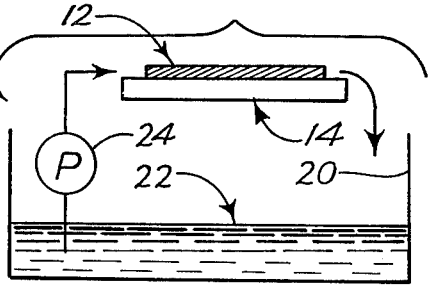
FIG. 1 is a simplified schematic drawing illustrating portions of an industrial grinder employing a coolant-liquid supply system constructed and operated in accordance with the present invention.
Figure 3:
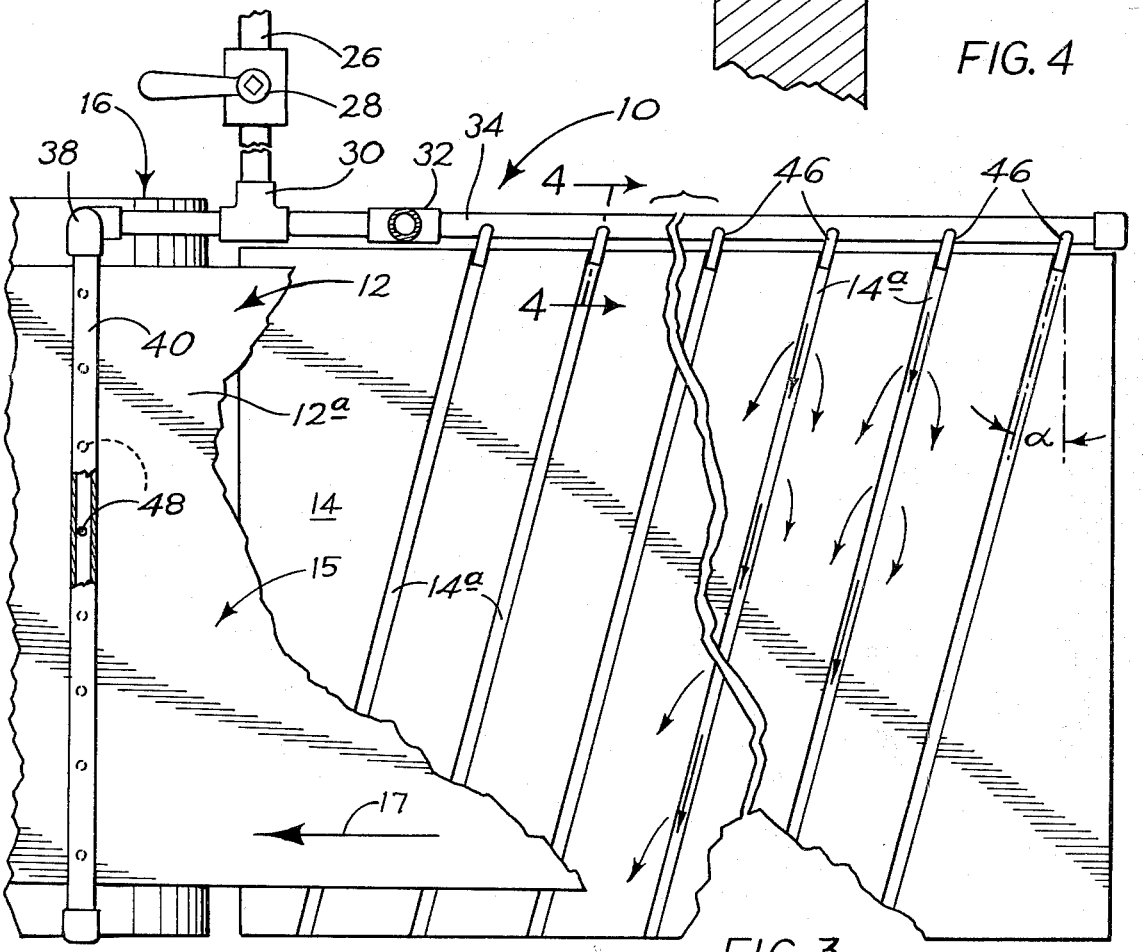
FIG. 3 is an enlarged, fragmentary and partially broken-away top plan view of the grinder of FIGS. 1 and 2.

Turning now to the drawings, and referring first of all to FIGS. 1–3, inclusive, illustrated generally at 10 is an industrial grinder incorporating apparatus for supplying a coolant liquid constructed in accordance with the present invention. In general terms, grinder 10 includes an elongated endless abrading belt 12, having what is referred to herein as a working run, shown generally at 12*a*, supported for movement over the top region surface of a generally horizontal platen 14. Region 15 which is directly above run 12*a* is referred to herein as a work zone. The left end of belt 12 in FIGS. 2 and 3 (the near end thereof in FIG. 1) is trained over a power-driven roller 16 (see FIG. 3) which drives the belt at a linear travel speed of around 5300-ft.-per-minute. The opposite end of the belt, hidden in all of the views, is trained over a suitable idler roller. With the belt driven, run 12*a* travels over the belt-contacting face in the platen in the direction of arrow 17.

All of the just-mentioned structure in grinder 10, except as will soon be explained, is entirely conventional in construction, and is supported on a suitable frame contained within a housing 18 (FIG. 1).

Still speaking in general terms, the perimeter of the assembly which includes belt 12, platen 14 and the rollers training the belt is exposed along the sides of housing 18, with an open-top tank, or reservoir, shown schematically at 20 in FIG. 1, disposed therebeneath inside the housing holding a supply of a suitable coolant liquid, such as that shown generally at 22 in FIG. 1. While different coolant liquids may be used, one which has been found to be effective for the purpose intended herein is a 50–50% mixture by weight of water and a commercially available product called CINCOOL FIVE STAR FORTY, made by Cincinnati Milacron Co., Cincinnati, Ohio.

With attention directed particularly to FIG. 1, associated with all of the structure mentioned so far is a recirculating plumbing or conduit system, or means, for liquid 22—such including a recirculating pump 24, which operates herein to recirculate fluid at the rate of about 400-gallons-per-hour, and various conduits, still to be described, which cause a recirculating flow of liquid as indicated generally by the flow arrows in FIG. 1. Coolant liquid is drawn from tank 20, supplied under pressure to an area adjacent the top side of platen 14, and thereafter returned by gravity to the tank.

Figure 4:
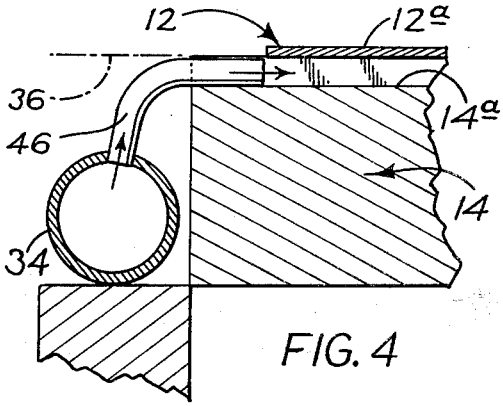
FIG. 4 is an enlarged cross-sectional view taken generally along line 4—4 in FIG. 3, illustrating the direction of flow of a coolant liquid from a manifold through nozzles and into a groove formed in the platen of the grinder of FIG. 1–3.

Placing attention now primarily on FIGS. 2–4, inclusive, the conduit system referred to generally above includes a main supply conduit 26 which extends from the outlet in pump 24. Conduit 26 feeds coolant liquid through a main control valve 28, and through a pair of T-fittings 30, 32 to a conduit, or manifold, 34 which extends horizontally along what will be referred to as the back side of platen 14. As can be seen particularly in FIG. 4, conduit 34 lies well below the plane, shown at 36, of the top surface of the platen. Coolant liquid also flows through fitting 30, and through another fitting 38 to a conduit 40 which extends substantially horizontally over belt 12, downstream, generally speaking, from the belt's working run 12*a*. Finally, coolant liquid is supplied through fitting 32 and through another control valve 42 (FIG. 2) to a flexible hose 44 (also FIG. 2).

Formed according to an important feature of the invention in the top surface of platen 14 are plural, parallel, generally equally spaced grooves, or troughs, such as troughs 14*a*. These troughs, which extend entirely across the width of the platen, are about ¼-inches wide, and slightly smaller in depth. As can be seen clearly in FIGS. 2 and 3, the long axes of the troughs are disposed each at an angle $\alpha$ (see FIG. 3) with respect to the transverse axis of the platen. Angle $\alpha$ herein has a value of about 15°. Accordingly, the troughs slope downwardly and to the left in FIGS. 2 and 3. Those ends of the troughs which appear to be the upper ends in FIGS. 2 and 3 are referred to as the upstream ends. The opposite ends are referred to as the downstream ends. Communicating between conduit 34 and the upstream ends of troughs 14*a* are angled nozzles, such as those shown at 46. Illustrated clearly in FIG. 4 is the fact that the ends of nozzles 46 which communicate directly with the troughs lie therein at an elevation which is below plane 36.

The combination including conduit 34, troughs 14*a* and nozzles 46 is referred to herein as a first outlet means.

Returning attention now to conduit 40, the underside of the same is prepared with plural bores, such as those shown at 48 in FIG. 3. Conduit 40 and bores 48 constitute a third outlet means herein.

Hose 44, whose special purpose will be explained shortly, is also preferred herein as a second outlet means.

Describing a typical grinding operation, a workpiece, such as the engine block head shown at 50 in FIG. 2, is placed on belt run 12*a* and, typically, is weighted down by a suitable weight, such as sandbag 52 (also shown in FIG. 2). With the grinder turned on, the operator holds the workpiece downwardly against the working run of the belt, allowing the left end of the piece (see FIG. 2) to rest against a conventional bumper, such as bumper 54, which forms part of the grinder. To minimize, according to the invention, the amount of heat build up permitted in the workpiece, and with a workpiece like engine block head 50, the operator initiates three distinct and important flows of coolant liquid 22. By opening valve 28, two important flows of coolant liquid start immediately. One of these is created through conduit 34, and diverted by nozzles 46 and troughs 14*a* to create and expanded film-like flow of coolant liquid in the interface region between the underside of run 12*a* and the belt-contacting upper face of the platen. This flow is clearly illustrated by the arrows appearing distributed over the platen adjacent the right side of FIG. 3. The other flow which begins immediately, takes place through conduit 40 and bores 48 to flood the top surface of the belt immediately downstream from bumper 54. This flow, it will be seen, acts directly and specifically on the belt, outside of the work zone in the grinder.

The third kind of flow—one which is possible with the kind of workpiece now being considered, takes place through hose 44, and through any suitable fitting, such as the one shown at 56 in FIG. 2, through inherent porting provided in the workpiece, thus to create a moving film of coolant liquid in the interface region between the workpiece and the belt's working run. With workpieces not so ported, valve 42 remains shut and hose 44 unused.

Coolant liquid flows, like those just described, carry away appreciable amounts of the working heat generated during a grinding operation, with "spent" liquid returned by gravity to tank 20 for air cooling, and subsequent recirculation through the conduit system described.

Experience has shown that the relatively simple, yet unique coolant flow structure and method of the invention significantly minimize heat build up, and resultant damage, in a grinding operation.

Reviewing, therefore, the method proposed by the invention, two different views of this method are taken herein. According to one view, the method includes the following steps:

(1)Supplying coolant liquid (via valve 23);

(2) Introducing a first flow of such liquid into the interface region between the platen and belt (via conduit 34, nozzles 46 and troughs 14*a*);

(3) Introducing a second flow of coolant fluid in the interface region between a workpiece and the belt's working run (via valve 42 and hose 44); and (4) Finally, creating a third flow of coolant liquid which is distributed directly onto the surface of the belt (via conduit 40 and bores 48).

According to a second view of the method of the invention, which view focuses on what might be thought of as the primary coolant flow in the interface region between the platen and belt, such view includes the following steps:

(1) Creating a flow of coolant liquid (via valve 28 and conduit 34);

(2) Diverting this flow into plural streams which move in the interface region between the belt and platen (via nozzles 46 and troughs 14*a*); and (3) Expanding the streams to produce a moving film of coolant liquid substantially spanning the interface region between the belt and platen (via the relative moving proximity of the underside of the belt and the upper face of the platen).

While a preferred construction for, and methods of practicing, the invention have been disclosed herein, it is appreciated that variations and modifications may take place without departing from the spirit of the invention.

It is claimed and desired to secure by Letters Patent:

1. In a grinder of the type employing a belt having working run supported by a platen for travel through a work zone, a system for supplying and circulating a coolant liquid, and conduit means including first outlet means for introducing a flow of coolant liquid in the interface region between said platen and said run to create a film of coolant liquid between the two, said first outlet means including a plurality of laterally spaced, elongated troughs formed in and extending completely across the belt-contacting face of said platen, each trough having upstream and downstream ends relative to the direction of coolant circulation in said system, an elongated manifold extending adjacent said upstream ends of said troughs, and a plurality of nozzle means communicating with said manifold and extending into said upstream ends of said troughs, for injecting coolant liquid under pressure into said troughs.

2. The grinder of claim 1, wherein, relative to the direction of travel of said run through said work zone, said upstream end in each trough is disposed upstream from the trough's downstream end.

3. A grinder of the type employing a moving belt having a working run for grinding a workpiece comprising:

a platen for supporting the working run, said platen including a belt-supporting planar portion defining a plurality of laterally spaced, elongated troughs obliquely disposed with respect to the direction of belt travel, each said trough having upstream and downstream ends; and conduit means with first outlet means including an elongated manifold extending adjacent said upstream ends of said troughs, and a plurality of nozzle means, one for each trough, communicating with said manifold and said upstream ends for injecting coolant liquid under pressure into each said trough.

4. The grinder of claim 1 or 3 wherein said conduit means further includes second outlet means for introducing a flow of coolant liquid in the interface region between said run and a workpiece.

5. The grinder of claim 4, wherein said conduit means further includes third outlet means for distributing coolant liquid onto the belt at a location which is downstream from the work zone relative to run travel.

6. The grinder of claim 3, further comprising means for supplying the coolant liquid under sufficient pressure that the coolant liquid passes out of said troughs and on to said planar portion between the belt and said platen.

7. The grinder of claim 6, wherein the ratio of the width of said troughs to the width of said planar portions is less than one to three.

8. The grinder of claim 6, wherein said troughs include parallel, upwardly extending walls.

9. The grinder of claim 6, wherein said troughs are disposed at an angle of approximately 75 degrees with respect to the direction of belt travel.

* * * * *